US011554462B1

(12) United States Patent
Kidd et al.

(10) Patent No.: US 11,554,462 B1
(45) **Date of Patent: *Jan. 17, 2023**

(54) METHODS OF CLEANING AND/OR NEUTRALIZING AN AT LEAST PARTIALLY LEACHED POLYCRYSTALLINE DIAMOND BODY AND RESULTING POLYCRYSTALLINE DIAMOND COMPACTS

(71) Applicant: US SYNTHETIC CORPORATION, Orem, UT (US)

(72) Inventors: Julie Ann Kidd, North Ogden, UT (US); Heather Marie Schaefer, North Ogden, UT (US); Jason K. Wiggins, Draper, UT (US); Cody Frisby, Payson, UT (US)

(73) Assignee: US Synthetic Corporation, Orem, UT (US)

( * ) Notice: Subject to any disclaimer, the term of this patent is extended or adjusted under 35 U.S.C. 154(b) by 372 days.

This patent is subject to a terminal disclaimer.

(21) Appl. No.: 16/748,569

(22) Filed: Jan. 21, 2020

Related U.S. Application Data

(63) Continuation of application No. 14/876,516, filed on Oct. 6, 2015, now Pat. No. 10,549,402.

(60) Provisional application No. 62/062,489, filed on Oct. 10, 2014.

(51) Int. Cl.

| | |
|---|---|
| ***B24D 3/10*** | (2006.01) |
| ***B24D 99/00*** | (2010.01) |
| ***E21B 10/567*** | (2006.01) |
| ***E21B 10/42*** | (2006.01) |

(52) U.S. Cl.
CPC ..... *B24D 3/10* (2013.01); *B24D 99/005* (2013.01); *E21B 10/42* (2013.01); *E21B 10/567* (2013.01)

(58) Field of Classification Search
CPC ..... E21B 10/46; E21B 10/567
See application file for complete search history.

(56) References Cited

U.S. PATENT DOCUMENTS

| | | | | | |
|---|---|---|---|---|---|
| 4,268,276 | A ‡ | 5/1981 | Bovenkerk | B01J 3/062 | 175/42 |
| 4,274,900 | A ‡ | 6/1981 | Mueller | B29C 55/023 | 156/22 |
| 4,410,054 | A ‡ | 10/1983 | Nagel | E21B 4/003 | 175/10 |
| 4,468,138 | A ‡ | 8/1984 | Nagel | F16C 17/04 | 384/30 |
| 4,560,014 | A ‡ | 12/1985 | Geczy | E21B 4/00 | 175/10 |
| 4,738,322 | A ‡ | 4/1988 | Hall | E21B 10/20 | 175/37 |
| 4,811,801 | A ‡ | 3/1989 | Salesky | E21B 10/56 | 175/43 |
| 4,913,247 | A ‡ | 4/1990 | Jones | E21B 10/54 | 175/43 |
| 5,016,718 | A ‡ | 5/1991 | Tandberg | E21B 10/04 | 175/33 |
| 5,092,687 | A ‡ | 3/1992 | Hall | E21B 4/003 | 384/30 |
| 5,120,327 | A ‡ | 6/1992 | Dennis | B22F 7/06 | 407/11 |
| 5,135,061 | A ‡ | 8/1992 | Newton, Jr. | B23B 27/148 | 175/42 |
| 5,154,245 | A ‡ | 10/1992 | Waldenstrom | E21B 10/5676 | 175/42 |
| 5,364,192 | A ‡ | 11/1994 | Damm | F16C 33/043 | 384/42 |
| 5,368,398 | A ‡ | 11/1994 | Damm | F16C 33/043 | 384/30 |
| 5,460,233 | A ‡ | 10/1995 | Meany | E21B 10/5673 | 175/42 |
| 5,480,233 | A ‡ | 1/1996 | Cunningham | E21B 4/003 | 384/30 |
| 5,544,713 | A ‡ | 8/1996 | Dennis | E21B 10/5673 | 175/42 |
| 6,793,681 | B1 ‡ | 9/2004 | Pope | A61F 2/30767 | 623/22 |
| 7,845,438 | B1 ‡ | 12/2010 | Vail | C22C 26/00 | 175/426 |
| 7,866,418 | B2 ‡ | 1/2011 | Bertagnolli | F16C 33/26 | 175/42 |
| 8,864,858 | B1 ‡ | 10/2014 | Kidd | B24D 18/00 | 51/293 |
| 10,549,402 | B1 * | 2/2020 | Kidd | E21B 10/42 | |
| 2012/0152064 | A1 ‡ | 6/2012 | Ladi | C22B 3/44 | 75/743 |
| 2014/0345321 | A1 ‡ | 11/2014 | Hall | C04B 35/52 | 63/4 |

OTHER PUBLICATIONS

Kidd et al.; U.S. Appl. No. 62/062,489, filed Oct. 10, 2014.

* cited by examiner
‡ imported from a related application

*Primary Examiner* — Pegah Parvini
(74) *Attorney, Agent, or Firm* — PCFB LLC

(57) ABSTRACT

Embodiments relate to polycrystalline diamond compacts ("PDCs"), methods of fabricating PDCs, and applications for such PDCs. In an embodiment, a method includes providing an at least partially leached polycrystalline diamond ("PCD") body. A residual amount of acid may remain in and/or on the at least partially leached PCD body. The method further includes removing and/or neutralizing at least some of the residual amount of acid from the at least partially leached PCD body and/or a substrate to which the at least partially leached PCD body is attached.

20 Claims, 5 Drawing Sheets

METHODS OF CLEANING AND/OR NEUTRALIZING AN AT LEAST PARTIALLY LEACHED POLYCRYSTALLINE DIAMOND BODY AND RESULTING POLYCRYSTALLINE DIAMOND COMPACTS

CROSS-REFERENCE TO RELATED APPLICATIONS

This application is a continuation of U.S. patent application Ser. No. 14/876,516 titled "Methods of Cleaning and/or Neutralizing an at Least Partially Leached Polycrystalline Diamond Body and Resulting Polycrystalline Diamond Compacts" and filed 6 Oct. 2015, which claims priority to U.S. Provisional Application No. 62/062,489 filed on 10 Oct. 2014, each of which is hereby incorporated by reference in its entirety.

BACKGROUND

Wear-resistant, polycrystalline diamond compacts ("PDCs") are utilized in a variety of mechanical applications. For example, PDCs are used in drilling tools (e.g., cutting elements, gage trimmers, etc.), machining equipment, bearing apparatuses, wire-drawing machinery, and in other mechanical apparatuses.

PDCs have found particular utility as superabrasive cutting elements in rotary drill bits, such as roller-cone drill bits and fixed-cutter drill bits. A PDC cutting element typically includes a superabrasive diamond layer commonly known as a diamond table. The diamond table is formed and bonded to a substrate using a high-pressure/high-temperature ("HPHT") process that sinters diamond particles under diamond-stable conditions. The PDC cutting element may also be brazed directly into a preformed pocket, socket, or other receptacle formed in a bit body. The substrate may optionally be brazed or otherwise joined to an attachment member, such as a cylindrical backing. A rotary drill bit typically includes a number of PDC cutting elements affixed to the bit body. It is also known that a stud carrying the PDC may be used as a PDC cutting element when mounted to a bit body of a rotary drill bit by press-fitting, brazing, or otherwise securing the stud into a receptacle formed in the bit body.

Conventional PDCs are normally fabricated by placing a cemented carbide substrate into a container with a volume of diamond particles positioned on a surface of the cemented carbide substrate. A number of such containers may be loaded into an HPHT press. The substrate(s) and volume of diamond particles are then processed under HPHT conditions in the presence of a catalyst material that causes the diamond particles to bond to one another to form a matrix of bonded diamond grains defining a polycrystalline diamond ("PCD") table. The catalyst material is often a metal-solvent catalyst (e.g., cobalt, nickel, iron, or alloys thereof) that is used for promoting intergrowth of the diamond particles.

In a conventional approach, a constituent of the cemented carbide substrate, such as cobalt from a cobalt-cemented tungsten carbide substrate, liquefies and sweeps from a region adjacent to the volume of diamond particles into interstitial regions between the diamond particles during the HPHT process. The cobalt acts as a catalyst to promote intergrowth between the diamond particles, which results in formation of a matrix of bonded diamond grains having diamond-to-diamond bonding therebetween, with interstitial regions between the bonded diamond grains being occupied by the solvent catalyst.

The presence of the metal-solvent catalyst in the PCD table is believed to reduce the thermal stability of the PCD table at elevated temperatures. For example, the difference in thermal expansion coefficient between the diamond grains and the metal-solvent catalyst is believed to lead to chipping or cracking of the PCD table during drilling or cutting operations, which can degrade the mechanical properties of the PCD table or cause failure. Additionally, some of the diamond grains can undergo a chemical breakdown or back-conversion to graphite via interaction with the solvent catalyst. At elevated high temperatures, portions of diamond grains may transform to carbon monoxide, carbon dioxide, graphite, or combinations thereof, thereby degrading the mechanical properties of the PDC.

One conventional approach for improving the thermal stability of a PDC is to at least partially remove the metal-solvent catalyst from the PCD table of the PDC by acid leaching. Because the leached interstitial regions of the PCD table create tortuous paths within the PCD, a small amount of residual acid may remain therein after being removed from the acid. However, despite the availability of a number of different PCD materials, manufacturers and users of PCD materials continue to seek improved PDCs and methods of manufacturing the same.

SUMMARY

Embodiments disclosed herein relate to methods of cleaning and/or neutralizing an at least partially leached PCD body to remove and/or neutralize at least some of a residual amount of acid therefrom that was used in an acid leaching process to form the at least partially leached PCD body. By cleaning and/or neutralizing the at least partially leached PCD body, interaction between the residual amount of acid and a cemented carbide substrate bonded to the at least partially leached PCD body may be reduced, which may reduce or eliminate damage to the cemented carbide substrate. For example, damaging the cemented carbide substrate by exposure to the residual amount of acid may be reduced or eliminated by limiting interaction with the residual amount of acid.

In an embodiment, a method is disclosed. A PCD body including bonded diamond grains that define a plurality of interstitial regions is provided. At least one interstitial material occupies at least a portion of the interstitial regions of the PCD body. The PCD body is at least partially leached using at least one acid to remove at least some of at least one interstitial material. At least a portion of any remaining acid is then removed and/or neutralized.

In an embodiment, a PDC includes a substrate and a PCD body. The PCD body includes a working surface and an interfacial surface bonded to the substrate. The PCD body further includes a first leached volume extending inwardly from the working surface and a second volume at least proximate to the substrate that includes at least one interstitial material. The first leached volume is at least partially depleted of the at least one interstitial material and substantially free of a residual amount of acid.

Further embodiments relate to applications utilizing the disclosed PDCs in various articles and apparatuses, such as rotary drill bits, bearing apparatuses and other articles and apparatuses.

Features from any of the disclosed embodiments may be used in combination with one another, without limitation. In addition, other features and advantages of the present disclosure will become apparent to those of ordinary skill in the art through consideration of the following detailed description and the accompanying drawings.

BRIEF DESCRIPTION OF THE DRAWINGS

The drawings illustrate several embodiments, wherein identical reference numerals refer to identical or similar elements or features in different views or embodiments shown in the drawings.

DETAILED DESCRIPTION

Embodiments disclosed herein relate to methods of cleaning and/or neutralizing an at least partially leached PCD body (e.g., an at least partially leached PCD table) to remove and/or neutralize at least some of a residual amount of acid therefrom that was used in an acid leaching process to form the at least partially leached PCD body. By cleaning and/or neutralizing the at least partially leached PCD body, interaction between the residual amount of acid and a cemented carbide substrate bonded to the at least partially leached PCD body can be reduced, which may reduce or eliminate damage to the cemented carbide substrate. For example, damaging the cemented carbide substrate by exposure to the residual amount of acid may be reduced or eliminated by limiting interaction with the residual amount of acid. The PDC embodiments disclosed herein may be used in a variety of applications, such as drilling tools (e.g., compacts, cutting elements, gage trimmers, etc.), machining equipment, bearing apparatuses, wire-drawing dies, and other apparatuses.

Figure 1:
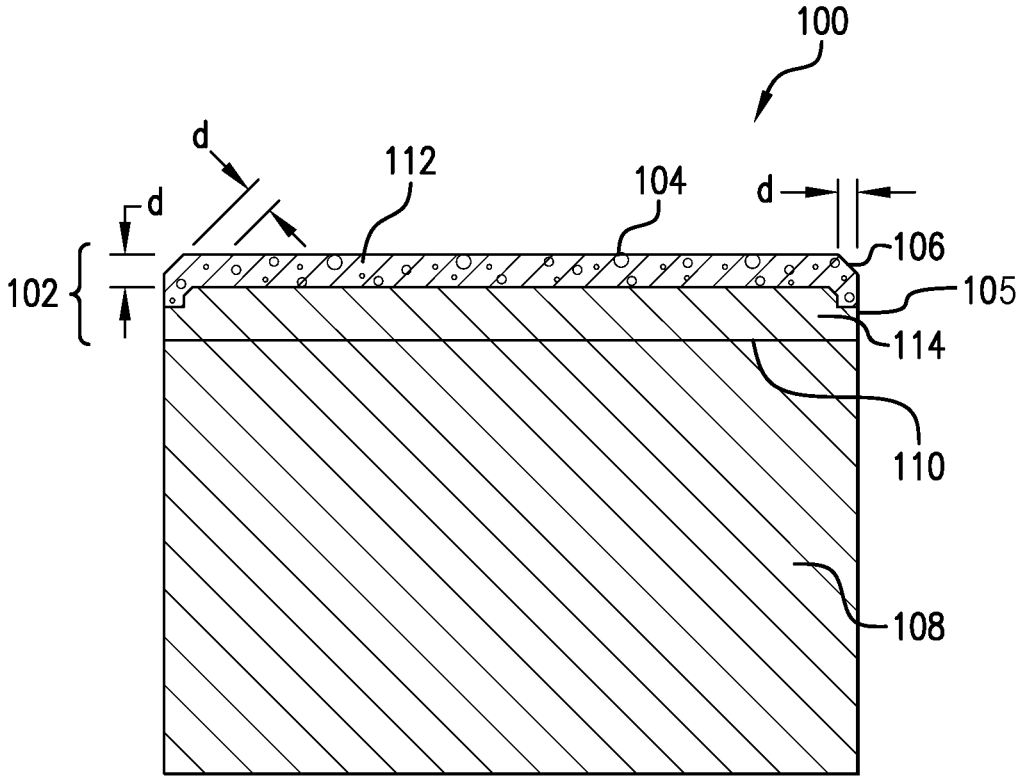
FIG. 1 is a cross-sectional view of an embodiment of a PDC including a PCD table bonded to a substrate.

FIG. 1 is a cross-sectional view of an embodiment of a PDC 100 including a PCD body/table 102. The PCD table 102 includes a plurality of directly bonded-together diamond grains exhibiting diamond-to-diamond bonding (e.g. sp3 bonding) therebetween, which define a plurality of interstitial regions. The PCD table 102 includes an upper, working surface 104, at least one side surface 105, and an optional chamfer 106 extending therebetween. Although FIG. 1 shows the working surface 104 as being substantially planar, the working surface 104 may exhibit a selected nonplanar topography, such as grooves or a curved concave or convex surface.

The PDC 100 further includes a substrate 108 having an interfacial surface 110 that is bonded to the PCD table 102. Although FIG. 1 shows the interfacial surface 110 as being substantially planar, the interfacial surface 110 may exhibit a selected nonplanar topography, such as a grooved, ridged, or other nonplanar interfacial surface. The substrate 108 may include a cemented carbide material, such as tungsten carbide, titanium carbide, chromium carbide, niobium carbide, tantalum carbide, vanadium carbide, or combinations thereof that may be cemented with iron, nickel, cobalt, or alloys therefor. For example, in an embodiment, the substrate 108 is a cobalt-cemented tungsten carbide substrate.

In the illustrated embodiment shown in FIG. 1, the PDC 100 exhibits a generally cylindrical shaped geometry. However, in other embodiments, the PDC 100 may exhibit a generally rounded rectangular geometry, a generally oval-shaped geometry, a generally wedge-shaped geometry, or any other suitable geometry.

The PCD table 102 is further at least partially leached using an acid to deplete the PCD table 102 of at least one interstitial constituent that previously occupied at least a portion of the interstitial regions thereof to form a first leached volume 112 adjacent to at least the working surface 104 and optionally adjacent to the at least one side surface 105 and/or the chamfer 106. The first leached volume 112 exhibits a depth "d" as measured from one or more of the working surface 104, the at least one side surface 105, or the chamfer 106. The PCD table 102 additionally includes a second volume 114 remote from the working surface 104 and adjacent to the substrate 108 that has not been leached so that at least a portion of the interstitial regions thereof are still at least partially occupied by the at least one interstitial material. In an embodiment, the leach depth "d" to which the first leach volume 112 extends may be about 50 μm to about 700 μm, such as about 50 μm to about 500 μm, about 200 μm to about 400 μm, about 150 μm to about 300 μm, or greater than about 400 μm. In another embodiment, the PCD table 102 may be leached so that the leach depth "d" may be approximately equal to a thickness of the PCD table 102. The first leached volume 112 may include a residual amount of the at least one interstitial material in amount of about 0.8 weight % to about 1.50 weight %, about 0.86 weight % to about 1.47 weight %, or about 0.90 weight % to about 1.2 weight %.

If the PDC 100 is not cleaned and/or neutralized, a residual amount of acid may occupy at least a portion of the interstitial regions of the first leached volume 112 after leaching and/or may have eluted out of the interstitial regions of the first leached volume 112 to at least partially cover one or more exterior surfaces of the at least partially leached PCD table 102 and/or the substrate 108. As will be discussed in more detail hereinbelow, the residual amount of acid within the at least partially leached PCD table 102 may be removed by placing the PDC 100 including the at least partially leached PCD table 102 in an oven, in an autoclave, in a vacuum, or other suitable technique; and/or the PDC 100 including the at least partially leached PCD table 102 may be neutralized by exposure to one or more bases. The cleaned and/or neutralized PDC 100 including the cleaned and/or neutralized PCD table 102 may exhibit a pH of about 5 to about 9 (e.g., about 7 to about 8, about 6.5 to about 7.5, or about 7) and/or an acid anion concentration less than about 3 ppm (e.g., about 2 ppm to about 3 ppm, about 1 ppm to about 2 ppm, or less than about 1 ppm). For example, the pH and acid anion concentration of the cleaned and/or neutralized PCD table 102 may be measured using a suitable electrochemical sensor, such as a Hannah Fluoride Portable Meter or other chemical probe.

By cleaning and/or neutralizing the PDC 100 including the PCD table 102 thereof, interaction between the residual amount of acid and the substrate 108 bonded thereto may be reduced, which may reduce or eliminate damage to the substrate 108. For example, leaching of the cementing constituent of the substrate 108 may be reduced or eliminated by limiting interaction with the residual amount of acid due to at least partially removing and/or neutralizing the residual amount of acid.

As discussed above, a portion of or substantially all of the interstitial regions of the first leached volume 112 and/or the second volume 114 of the PCD table 102 include at least one interstitial material therein. The at least one interstitial material may include a metal-solvent catalyst (e.g., cobalt, iron, nickel or alloys thereof), a carbonate-catalyst including alkali metal carbonate (e.g., one or more carbonates of Li, Na, and K), alkaline earth metal carbonates (e.g., one or more carbonates of Be, Mg, Ca, Sr, and Ba), a metallic infiltrant (e.g., cobalt, iron, nickel, tungsten, or alloys thereof), a metal oxide, graphite, fullerenes, any combination of the foregoing, or any other material. For example, the substrate 108 may comprise a cobalt-cemented tungsten carbide substrate, and the at least one interstitial material may comprise cobalt infiltrated from the cobalt-cemented tungsten carbide substrate. In an embodiment, a metal-solvent catalyst and/or a carbonate catalyst may facilitate diamond nucleation and growth during fabrication of the PCD table 102 from diamond particles during an HPHT sintering process.

Figure 2:
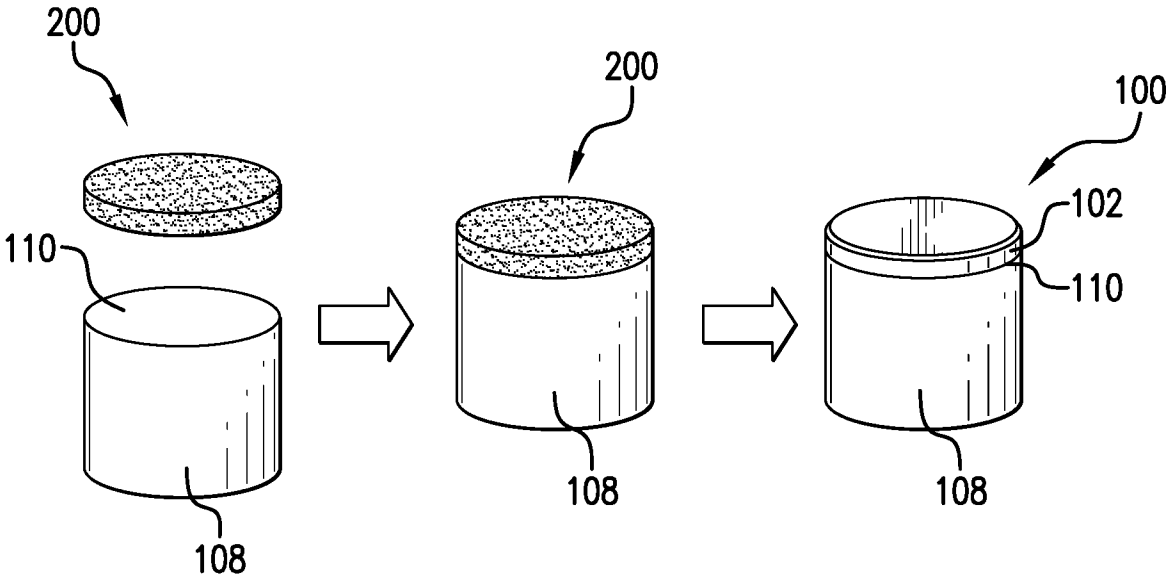
FIG. 2 is a schematic illustration of a method of fabricating the PDC shown in FIG. 1 according to an embodiment.

FIG. 2 is a schematic illustration of an embodiment of a method for fabricating the PDC 100 shown in FIG. 1. Referring to FIG. 2, a mass of diamond particles 200 is provided that exhibits, for example, an average diamond particle size between 0.5 μm and 150 μm. In some embodiments, the mass of diamond particles 200 may exhibit an average particle size of about 50 μm or less, such as about 30 μm or less or about 20 μm or less. In another embodiment, the average diamond particle size of the mass of diamond particles 200 may be about 10 μm to about 18 μm and, in some embodiments, about 15 μm to about 18 μm. The diamond particle size distribution of the mass of diamond particles may exhibit a single mode, or may exhibit a bimodal or greater grain size distribution. In various embodiments, the mass of diamond particles may include a portion exhibiting a relatively larger size (e.g., 100 μm, 90 μm, 80 μm, 70 μm, 60 μm, 50 μm, 40 μm, 30 μm, 20 μm, 15 μm, 12 μm, 10 μm, 8 μm) and another portion exhibiting at least one relatively smaller size (e.g., 30 μm, 20 μm, 10 μm, 15 μm, 12 μm, 10 μm, 8 μm, 4 μm, 2 μm, 1 μm, 0.5 μm, less than 0.5 μm, 0.1 μm, less than 0.1 μm). In an embodiment, the mass of diamond particles may include a portion exhibiting a relatively larger size between about 40 μm and about 15 μm and another portion exhibiting a relatively smaller size between about 12 μm and 2 μm. Of course, the mass of diamond particles may also include three or more different sizes (e.g., one relatively larger size and two or more relatively smaller sizes), without limitation. It should be noted that the as-sintered average diamond grain size may be substantially the same or different than that of the precursor diamond particles used.

The mass of diamond particles 200 is positioned adjacent to the interfacial surface 110 of the substrate 108. A catalyst (e.g., any of the metal-solvent catalysts and/or carbonate catalysts disclosed herein) may be provided in particulate form mixed with the mass of diamond particles, as a thin foil or plate placed adjacent to the mass of diamond particles, from a cemented carbide substrate including a metal-solvent catalyst (e.g., iron, nickel, cobalt, or alloys thereof), or combinations of the foregoing.

In order to form the PDC 100, the mass of diamond particles 200 and the substrate 108 may be subjected to an HPHT process effective to bond the diamond particles 200 together via diamond-to-diamond boding to form the PCD table 102 and bond the PCD table 102 so formed to the interfacial surface 110 of the substrate 108. If a catalyst is provided (e.g., metal-solvent or carbonate catalyst), the catalyst may liquefy and infiltrate the mass of diamond particles 200 to promote nucleation growth between adjacent diamond particles of the mass of diamond particles 200. Any infiltrated catalyst present in the PCD table 102 may be interstitially disposed between bonded diamond grains of the PCD table 102. In an embodiment, the infiltrated catalyst from the substrate 108 may form a strong bond between the PCD table 102 and the substrate 108 by infiltrating the interstitial regions of the PCD table 102. For example, if the substrate 108 is a cobalt-cemented tungsten carbide substrate, cobalt from the substrate 108 may be liquefied and infiltrate the mass of diamond particles 200 to catalyze formation of the PCD table 102 and bond the PCD table 102 to the substrate 108 upon cooling. As an alternative or in addition to infiltrating the catalyst into the mass of diamond particles 200, in other embodiments, the catalyst may be mixed with the mass of diamond particles 200.

In order to effectively sinter the mass of diamond particles 200 to form the PCD table 102, the mass of diamond particles 200 and the substrate 108 may be enclosed in a pressure transmitting medium such as a refractory metal can, graphite structure, pyrophyllite, and/or another suitable pressure transmitting structure. The HPHT process uses an ultra-high pressure press at a temperature of at least about 1000° C. (e.g., about 1100° C. to about 2200° C., or about 1200° C. to about 1450° C.) and a pressure in the pressure transmitting medium of at least about 5 GPa (e.g., at least about 7.5 GPa, at least about 9.0 GPa, at least about 10.0 GPa, at least about 11.0 GPa, at least about 12.0 GPa, at least about 14.0, or about 7.5 GPa to about 9.0 GPa). The HPHT process may have a duration and HPHT conditions sufficient to sinter the mass of diamond particles 200 together in the presence of any of the catalyst materials disclosed herein to form the PCD table 102 that bonds to the substrate 108. The PCD table 102 includes bonded diamond grains exhibiting diamond-to-diamond bonding therebetween and defining interstitial regions occupied by the catalyst. Examples of suitable HPHT sintering processes conditions that may be used to practice any of the embodiments disclosed herein are disclosed in U.S. Pat. No. 7,866,418 which is incorporated herein, in its entirety, by this reference.

It should be noted that the pressure values employed in the HPHT process disclosed herein refer to the pressure in the pressure transmitting medium (i.e., cell pressure) at room temperature (e.g., about 25° C.) with application of pressure using an ultra-high pressure press and not the pressure applied to exterior of the cell assembly. The actual pressure in the pressure transmitting medium at sintering temperatures may be slightly higher than the pressure in the pressure transmitting medium at room temperature.

After the HPHT sintering process, the PCD table 102 may be at least partially leached to remove at least one interstitial material from a region thereof. In an embodiment, the PCD table 102 is partially immersed in or exposed to a leaching agent including at least one leaching acid to leach the at least one interstitial material from the PCD table 102 to the selected depth "d" from at least one surface of the PCD table 102, as previously discussed with respect to FIG. 1. Portions of the PDC 100 may be masked with an acid-resistant material to prevent certain areas from being leached, such as the second volume 114 (FIG. 1) and/or the substrate 108. For example, the PCD table 102 may be leached by immersion in an acid, such as hydrochloric acid, nitric acid (e.g. aqua regia, a solution of 90% nitric acid/10% de-ionized water by volume), phosphoric acid, acetic acid, hydrofluoric acid, any suitable acid, or any combination of the foregoing acids. As another example, the PCD table 102 may be immersed in the acid for about less than 1 day to 7 days (e.g. about 3, 5, or 7 days) or for a few weeks (e.g. about 4 weeks) depending on the process employed.

After leaching, the PCD table 102 may then be processed to remove and/or neutralize at least a portion of the residual amount of acid remaining from the leaching process. In an embodiment, at least some of the residual amount of acid may be removed and/or neutralized by subjecting the PDC 100 including the at least partially leached PCD table 102 thereof to a thermal process. In such a thermal process, the PDC 100 including the at least partially leached PCD table 102 thereof may be heated in an oven for at a temperature and a duration sufficient to remove and/or neutralize at least some of the residual amount of acid from the PCD table 102, but below a temperature (e.g., below about 700° C. or above about 700° C. in an appropriate atmosphere) at which the diamond grains of the PCD table 102 may significantly degrade (e.g., such as graphitize). The processing temperature may be constant, cyclic, or varied over interval portion of the duration. The temperature and duration of the process may be determined at least partially based on one or more of the diamond particle size used to form the PCD table 102, the diamond particle modal distribution used to form the PCD table 102, the amount of diamond-to-diamond bonding in the PCD table 102, the HPHT sintering process used to form the PCD table 102, the PCD table's 102 porosity, the PCD table's 102 average pore size, type of material(s) leached, leach time, leach depth, type of acid used to leach the PCD table 102, or the desired pH or anion concentration for the PDC 100 including the PCD table 102 thereof. The at least partially leached PCD table 102 may also have its pH and/or anion concentration monitored during the cleaning and/or neutralization process. The heating device (e.g., in an oven) may be ventilated, may be held under or exposed to a vacuum, or may heat the PDC 100 in an inert environment (e.g., under a nitrogen or an argon atmosphere). For example, the PDC 100 including the at least partially leached PCD table 102 thereof may be heated in an oven at a temperature below about 700° C. (e.g., below about 600° C., below about 450° C.). In another embodiment, the PDC 100 including the at least partially leached PCD table 102 may be heated in an oven at a temperature of about 100° C. to about 500° C. In another embodiment, the PDC 100 including the at least partially leached PCD table 102 thereof may be cleaned in an oven at a temperature of about 100° C. to about 700° C., about 150° C. to about 400° C., about 250° C. to about 400° C., about 300° C. to about 450° C., about 350° C. to about 400° C., or about 290° C. to about 350° C. Using any of the foregoing temperature ranges, the PDC 100 including the at least partially leached PCD table 102 thereof may be heated in an oven for a time period about 20 minutes to about 240 minutes (e.g. about 60 minutes to about 120 minutes, about 80 minutes to about 100 minutes).

In another embodiment, at least some of the residual amount of acid may be removed and/or neutralized from the PDC 100 including the at least partially leached PCD table 102 thereof by heating and/or pressurizing in an autoclave. The PDC 100 including the at least partially leached PCD table 102 thereof may be heated and/or pressurized in the autoclave at a temperature and duration sufficient to remove and/or neutralize at least some of the residual amount of acid from the PCD table 102. The autoclave may heat the PDC 100 including the at least partially leached PCD table 102 thereof at atmospheric pressure (e.g., about 1 atm) or at a pressure exceeding atmospheric pressure (e.g., above about 1 atm, above about 1.5 atm). In an embodiment, the pressure in the autoclave is about 15 psi to about 40 psi above atmospheric pressure (e.g., about 20 psi above atmospheric pressure, about 30 psi above atmospheric pressure). The processing temperature and pressure may be constant, cyclic, or varied over a time interval. The temperature, pressure, and duration of the cleaning process may be determined based on any one or combination of the previously described parameters. In an embodiment, the PDC 100 including the at least partially leached PCD table 102 thereof may be cleaned in an autoclave at a temperature of about 90° C. to about 350° C. (e.g., about 100° C. to about 230° C., about 110° C. to about 160° C., about 120° C. to about 230° C., or about 110° C. about 140° C.) for a time period between about 1 hour to about 36 hours (e.g. about 1 hour to about 4 hours, about 4 hours to about 22 hours, or about 22 hours to about 32 hours). The PDC 100 including the at least partially leached PCD table 102 may also have its pH and/or anion concentration monitored during the cleaning process.

In another embodiment, at least some of the residual amount of acid may be removed and/or neutralized by subjecting the PDC 100 including the at least partially leached PCD table 102 to a vacuum (e.g., at a pressure less than ambient atmospheric pressure) provided by a vacuum chamber in which the PDC 100 is disposed. In this embodiment, the PDC 100 including the at least partially leached PCD table 102 is placed in a vacuum chamber having a vacuum drawn with a pressure and temperature sufficient to evaporate at least some of the residual amount of acid from the PDC 100 including the at least partially leached PCD table 102 thereof. The PDC 100 including the at least partially leached PCD table 102 thereof may also be heated while in the vacuum. For example, the temperature, pressure, and duration of the cleaning process may be determined based on any of the previously described parameters. The cleaning temperature and pressure may be constant, cyclic or varied over a time interval. The PDC 100 including the at least partially leached PCD table 102 may also have its pH and/or anion concentration monitored during the cleaning process.

In another embodiment, at least some of the residual amount of acid may be removed and/or neutralized by cleaning and/or neutralizing the PDC 100 including the at least partially leached PCD table 102 with one or more bases. For example, the at least partially leached PCD table 102 may be rinsed and/or immersed in a basic solution, such as an aqueous solution of sodium hydroxide, calcium hydroxide, mixtures thereof, or other suitable basic solution. In another embodiment, the at least partially leached PCD table 102 may be subjected to a flow of a gaseous base and/or a liquid base. Additionally, the at least partially leached PCD table 102 may have at least some of the residual amount of acid removed and/or neutralized by enclosing the PDC 100 including the at least partially leached PCD table 102 in a powdered base material, such as sodium bicarbonate powder and/or calcium carbonate.

In an embodiment, the at least partially leached PCD table 102 may be subjected to a rinsing process before and/or after at least some residual amount of acid is removed therefrom by the cleaning and/or neutralizing processes disclosed herein. For example, the at least partially leached PCD table 102 may be rinsed in de-ionized water or any solution that is capable of dissolving or removing at least some of the residual amount of acid from the at least partially leached PCD table 300.

In an embodiment, a preformed PCD table may be formed according to the method shown in FIG. 2, and the PCD table 102 may then be separated from the substrate 108 to form a preformed PCD table. The PCD table 102 may be separated from the substrate 108 using laser cutting, electrical discharge machining ("EDM"), combinations thereof, or other suitable methods.

In another embodiment, a preformed PCD table may be formed without the use of a substrate. A mass of diamond particles having any of the above-mentioned average diamond particle sizes and distributions may be mixed with a suitable amount of catalyst material. For example the amount of catalyst material present in the mass of diamond particles may be less than about 7.5 weight %. The mass of diamond particles is then positioned in a pressure transmitting medium that is the same or similar to any of the previously discussed pressure transmitting mediums to form a cell assembly. The cell assembly is then subjected to the HPHT sintering process at a temperature and pressure sufficient to form the diamond-to-diamond bonding (e.g., at temperature of at least 1000° C. and a pressure of at least 5.0 GPa or any of the HPHT sintering conditions disclosed herein). The presence of a catalyst facilitates intergrowth between the mass of diamond particles during the HPHT sintering process and forms a PCD table comprising bonded diamond grains defining interstitial regions having the catalyst disposed within at least a portion of the interstitial regions.

The preformed PCD table may be at least partially leached to remove at least one interstitial material according to any of the embodiments disclosed herein. In an embodiment, the preformed PCD table is completely immersed in any of the acids disclosed herein to leach at least one interstitial material therein to a select depth "d" from all surfaces of the preformed PCD table. Alternatively, the at least one interstitial material may be leached from less than all of the surfaces of the PCD table. In another embodiment, the preformed PCD table may be immersed in any of the acids disclosed herein or otherwise leached for a sufficient time to remove at least one interstitial material substantially completely from at least a region of the preformed PCD table. The at least partially leached PCD table may then be cleaned and/or neutralized to remove and/or neutralize at least a portion of the residual amount of acid remaining after the leaching process using at least one of an oven, autoclave, a vacuum, or a base using any of the techniques disclosed herein.

The cleaned and/or neutralized and at least partially leached PCD table may then be reattached to a substrate using any suitable method. For example, the cleaned and/or neutralized and at least partially leached PCD table may be placed adjacent to a substrate, such as the substrate 108. The cleaned and/or neutralized and at least partially leached PCD table and the substrate may then be placed into a pressure transmitting cell and subjected to an HPHT process (e.g., a temperature at least about 1000° C. and a pressure at least about 5 GPa or any other HPHT conditions disclosed herein). In an embodiment, an infiltrant material from the substrate or from another source melts and infiltrates the unoccupied interstitial regions of the cleaned and/or neutralized and at least partially leached PCD table. For example, cobalt from a cobalt-cemented carbide substrate may melt and infiltrate into the unoccupied interstitial regions of the cleaned and/or neutralized and at least partially leached PCD table. The infiltrant material may facilitate bonding the infiltrated PCD table to the substrate upon cooling from the HPHT process. The reattached PCD table may have at least one infiltrant material removed to a select depth "d" from at least one surface according to any of the methods described herein to form the PDC 100 shown in FIG. 1. Additionally, the PDC 100 may be cleaned and/or neutralized to remove and/or chemically alter at least some of the residual amount of acid from the at least partially leached PCD table 102 using at least one of an oven, autoclave, a vacuum, or a base using any of the techniques described herein so that the resultant leached PDC 100 exhibits a pH of about 5 to about 9 (e.g., about 7 to about 8, about 6.5 to about 7.5, or about 7) and/or an acid anion concentration less than about 3 ppm (e.g., about 2 ppm to about 3 ppm, about 1 ppm to about 2 ppm, or less than about 1 ppm).

Figure 3A:
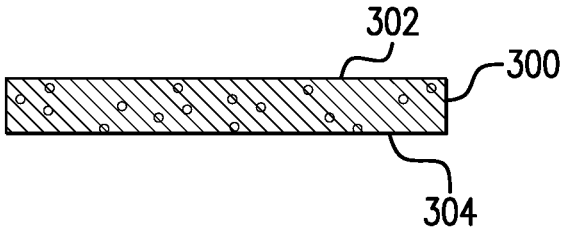
FIGS. 3A and 3B are cross-sectional views of an at least partially leached PCD body that schematically illustrate a cleaning and/or neutralization process according to an embodiment.
Figure 3B:
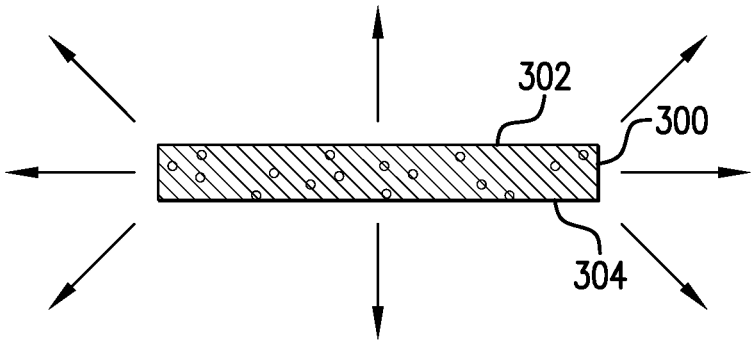

FIGS. 3A and 3B schematically illustrate a process for cleaning and/or neutralizing a preformed PCD table according to an embodiment. FIG. 3A is a cross-sectional view of an at least partially leached PCD table 300 (i.e., a porous, preformed PCD table) including a first surface 302 and an opposing second interfacial surface 304 may be provided. The at least partially leached PCD table 300 includes a plurality of interstitial regions from which at least one interstitial material has been removed from at least one of the plurality of interstitial regions. A network of at least partially interconnected pores may be formed by removing the at least one interstitial material. A residual amount of acid from the leaching process may partially fill at least some of the plurality of interstitial regions of the at least partially leached PCD table 300 and/or at least partially cover one or more exterior surfaces of the at least partially leached PCD table 300 after completing the leaching process. The residual amount of acid may adversely affect a cemented carbide substrate to which the at least partially leached PCD table 300 is to be attached and/or limit complete or effective infiltration of the at least partially leached PCD table 300 with an infiltrant material. FIG. 3B is a cross-sectional view of the at least partially leached PCD table 300 during processing thereof to remove and/or neutralize at least some of the residual amount of acid using any of the techniques described above for the PDC 100.

In an embodiment, the at least partially leached PCD table 300 may be subjected to a rinsing process before and/or after at least some residual amount of acid on and/or in the at least partially leached PCD table 300 is removed and/or neutralized. For example, the at least partially leached PCD table 300 may be rinsed in de-ionized water or any solution that is capable of dissolving, diluting, removing, or combinations thereof at least some of the residual amount of acid from the at least partially leached PCD table 300.

The disclosed embodiments of PDCs may be used in a number of different applications including, but not limited to, use in a rotary drill bit (FIGS. 4 and 5), a thrust-bearing apparatus (FIG. 6), a radial-bearing apparatus (not shown), a subterranean drilling system (not shown), and a wire-drawing die (not shown). It should be emphasized that the various applications discussed above are merely some examples of applications in which the PDCs embodiments may be used. Other applications are contemplated, such as employing the disclosed PDCs embodiments in friction stir welding tools.

Figure 4:
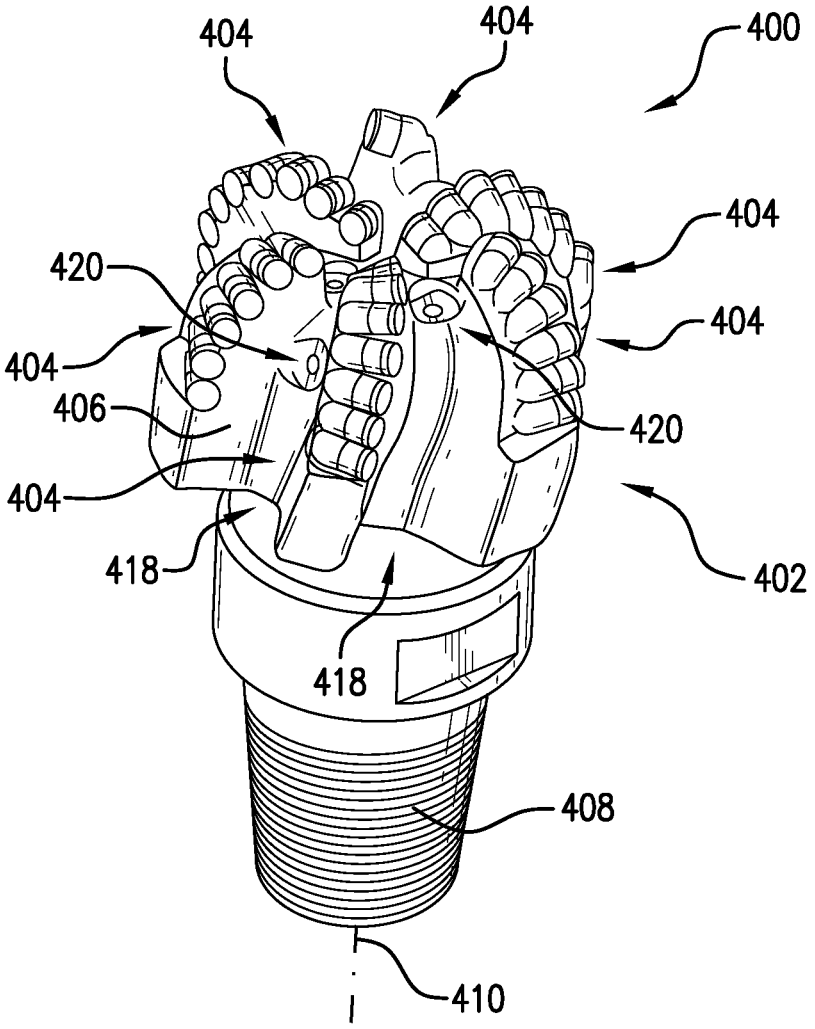
FIG. 4 is an isometric view of a rotary drill bit according to an embodiment that may employ one or more of the disclosed processed PDC embodiments.
Figure 5:
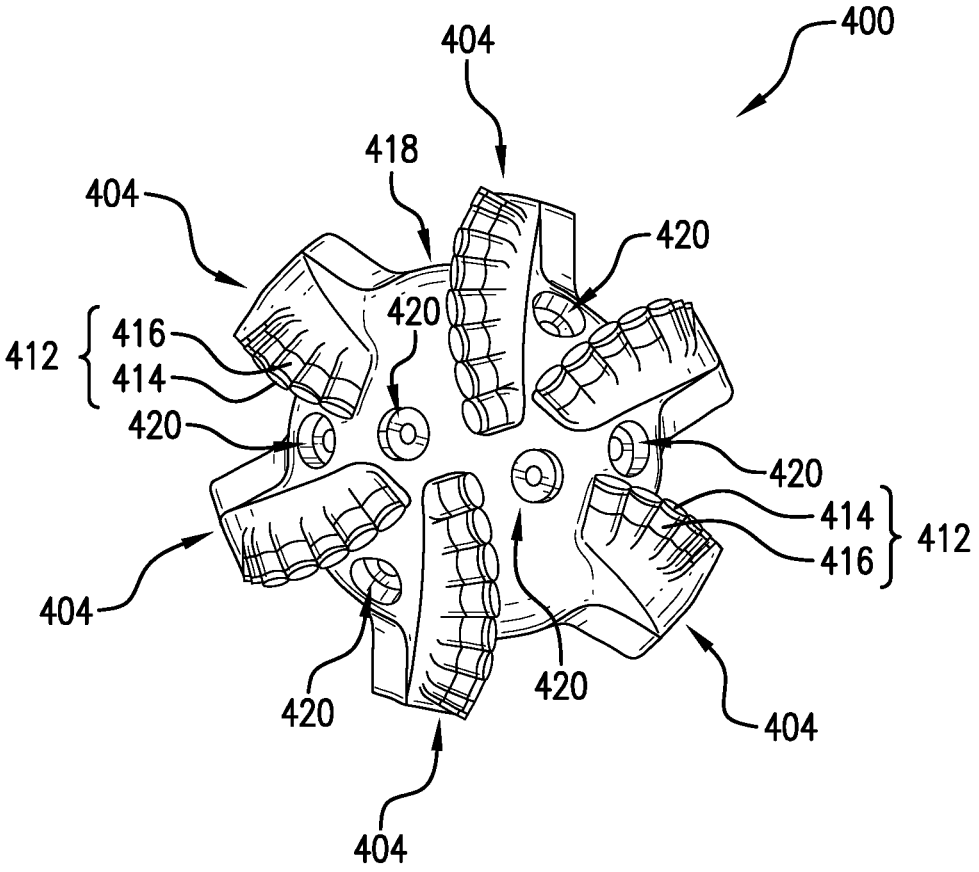
FIG. 5 is a top elevation view of the rotary drill bit shown in FIG. 4.

FIG. 4 is an isometric view and FIG. 5 is a top elevation view of an embodiment of a rotary drill bit 400. The rotary drill bit 400 includes at least one PDC configured according to any of the previously described cleaned and/or neutralized PDC embodiments. The rotary drill bit 400 includes a bit body 402 having radially and longitudinally extending blades 404 with leading faces 406, and a threaded pin connection 408 for connecting the bit body 402 to a drilling string. The bit body 402 defines a leading end structure for drilling into a subterranean formation by rotation about a longitudinal axis 410 and application of weight-on-bit. At least one PDC cutting element, configured according to any of the previously described processed (e.g., cleaned and/or neutralized) PDC embodiments (e.g., the PDC 100 shown in FIG. 1), may be affixed to rotary drill bit 400. With reference to FIG. 5, a plurality of PDCs 412 is secured to the blades 404. For example, each PDC 412 may include a PCD table 414 bonded to a substrate 416. More generally, the PDC 412 may comprise any PDC disclosed herein, without limitation. Also, circumferentially adjacent blades 404 define so-called junk slots 418 therebetween. Additionally, the rotary drill bit 400 may include a plurality of nozzle cavities 420 for communicating drilling fluid from the interior of the rotary drill bit 400 to the PDCs 412.

FIGS. 4 and 5 merely depict one embodiment of a rotary drill bit that employs at least one cutting element that comprises a PDC fabricated and structured in accordance with the disclosed embodiments, without limitation. The rotary drill bit 400 is used to represent any number of earth-boring tools or drilling tools, including, for example, core bits, roller-cone bits, fixed-cutter bits, eccentric bits, bicenter bits, reamers, reamer wings, or any other downhole tool including superabrasive compacts, without limitation.

The cleaned and/or neutralized PDCs disclosed herein (e.g., PDC 100 of FIG. 1) may also be utilized in applications other than cutting technology. For example, the disclosed PDC embodiments may be used in wire-drawing dies, bearings, artificial joints, inserts, cutting elements, and heat sinks. Thus, any of the cleaned and/or neutralized PDCs disclosed herein may be employed in an article of manufacture including at least one superabrasive element or compact.

Thus, the embodiments of cleaned and/or neutralized PDCs disclosed herein may be used in any apparatus or structure in which at least one conventional PDC is typically used. In an embodiment, a rotor and a stator, assembled to form a thrust-bearing or a radial bearing apparatus, may each include one or more cleaned and/or neutralized PDCs (e.g., PDC 100 of FIG. 1) configured according to any of the embodiments disclosed herein and may be operably assembled to a downhole drilling assembly. U.S. Pat. Nos. 4,410,054; 4,560,014; 5,364,192; 5,368,398; and 5,480,233, the disclosure of each of which is incorporated herein, in its entirety, by this reference, disclose subterranean drilling systems within which bearing apparatuses utilizing PDCs disclosed herein may be incorporated. The embodiments of PDCs disclosed herein may also form all or part of heat sinks, wire dies, bearing elements, cutting elements, cutting inserts (e.g., on a roller-cone-type drill bit), machining inserts, or any other article of manufacture as known in the art. Other examples of articles of manufacture that may use any of the cleaned and/or neutralized PDCs disclosed herein are disclosed in U.S. Pat. Nos. 4,811,801; 4,268,276; 4,468,138; 4,738,322; 4,913,247; 5,016,718; 5,092,687; 5,120,327; 5,135,061; 5,154,245; 5,460,233; 5,544,713; and 6,793,681, the disclosure of each of which is incorporated herein, in its entirety, by this reference.

While various aspects and embodiments have been disclosed herein, other aspects and embodiments are contemplated. The various aspects and embodiments disclosed herein are for purposes of illustration and are not intended to be limiting. Additionally, the words "including," "having," and variants thereof (e.g., "includes" and "has") as used herein, including the claims, shall be open ended and have the same meaning as the word "comprising" and variants thereof (e.g., "comprise" and "comprises") and mean "including, but not limited to."

What is claimed is:

1. A method, comprising:

providing a polycrystalline diamond body including a plurality of diamond grains defining a plurality of interstitial regions having at least one interstitial material occupying at least a portion of the plurality of interstitial regions;

at least partially leaching at least some of the at least one interstitial material from the polycrystalline diamond body to form an at least partially leached polycrystalline diamond body including a residual amount of acid;

removing and/or neutralizing at least a portion of the residual amount of acid by exposing at least a portion of the at least partially leached polycrystalline diamond body to a neutralizing liquid; and after removing and/or neutralizing the at least a portion of the residual amount of acid, heating the at least partially leached polycrystalline diamond body to remove and/or neutralize an additional portion of the residual amount of acid.

2. The method of claim 1, wherein the residual amount of acid includes at least one of hydrochloric acid, nitric acid, phosphoric acid, acetic acid, or hydrofluoric acid.

3. The method of claim 1, further comprising rinsing the at least partially leached polycrystalline diamond body before and/or after heating the at least partially leached polycrystalline diamond body.

4. The method of claim 1, wherein heating the at least partially leached polycrystalline diamond body includes heating the at least partially leached polycrystalline diamond body to a temperature about 100° C. to about 700° C.

5. The method of claim 1, wherein heating the at least partially leached polycrystalline diamond body includes heating the at least partially leached polycrystalline diamond body to a temperature about 150° C. to about 400° C.

6. The method of claim 1, wherein heating the at least partially leached polycrystalline diamond body includes heating the at least partially leached polycrystalline diamond body to a temperature about 250° C. to about 400° C.

7. The method of claim 1, wherein heating the at least partially leached polycrystalline diamond body includes heating the at least partially leached polycrystalline diamond body for a time period about 20 minutes to about 240 minutes.

8. The method of claim 1, wherein heating the at least partially leached polycrystalline diamond body includes heating the at least partially leached polycrystalline diamond body at a selected temperature and for a selected duration, wherein the selected temperature and the selected duration is determined at least partially based on at least one of diamond particle size used to form the polycrystalline diamond body, diamond grain size distribution of the polycrystalline diamond body, amount of diamond-to-diamond bonding in the at least partially leached polycrystalline diamond body, porosity of the at least partially leached polycrystalline diamond body, average pore size of the at least partially leached polycrystalline diamond body, type of at least one interstitial material leached, leach time, leach depth, type of acid used to leach the at least partially leached polycrystalline diamond body, desired pH of the at least partially leached polycrystalline diamond body, or desired anion concentration in the at least partially leached polycrystalline diamond body.

9. The method of claim 1, wherein heating the at least partially leached polycrystalline diamond body includes heating the at least partially leached polycrystalline diamond body at more than one temperature.

10. The method of claim 1, wherein removing and/or neutralizing at least a portion of the residual amount of acid includes heating the at least partially leached polycrystalline diamond body in an autoclave.

11. The method of claim 10, wherein heating the at least partially leached polycrystalline diamond body in the autoclave includes heating the at least partially leached polycrystalline diamond body in the autoclave at a temperature about 120° C. to about 230° C.

12. The method of claim 10, wherein heating the at least partially leached polycrystalline diamond body in the autoclave includes heating the at least partially leached polycrystalline diamond body in the autoclave for a time period about 1 hour to about 4 hours.

13. The method of claim 1, wherein the at least partially leached polycrystalline diamond body is bonded to a substrate prior to removing and/or neutralizing at least a portion of the residual amount of acid.

14. The method of claim 1, wherein at least partially leaching at least some of the at least one interstitial material from the polycrystalline diamond body to form an at least partially leached polycrystalline diamond body includes removing the at least one interstitial material throughout at least a majority of the polycrystalline diamond body.

15. The method of claim 1, wherein the at least one interstitial material includes at least one of a metal-solvent catalyst or a metallic infiltrant.

16. A method, comprising:

providing a polycrystalline diamond body including a plurality of diamond grains defining a plurality of interstitial regions having at least one interstitial material occupying at least a portion of the plurality of interstitial regions;

at least partially leaching at least some of the at least one interstitial material from the polycrystalline diamond body to form an at least partially leached polycrystalline diamond body including a residual amount of acid;

exposing at least a portion of the at least partially leached polycrystalline diamond body to a neutralizing liquid; and after exposing the at least a portion of the at least partially leached polycrystalline diamond body to the neutralizing liquid, removing and/or neutralizing at least a portion of the residual amount of acid by heating the at least partially leached polycrystalline diamond body while exposing the at least partially leached polycrystalline diamond body to a vacuum.

17. A method, comprising:

providing a polycrystalline diamond compact including:

a substrate; and a polycrystalline diamond body bonded to the substrate, the polycrystalline diamond body including a plurality of diamond grains defining a plurality of interstitial regions having at least one interstitial material occupying at least a portion of the plurality of interstitial regions;

at least partially leaching at least some of the at least one interstitial material from the polycrystalline diamond body to form an at least partially leached polycrystalline diamond body including a residual amount of acid;

removing and/or neutralizing at least a portion of the residual amount of acid; and after removing and/or neutralizing the at least a portion of the residual amount of acid, removing and/or neutralizing at least another portion of the residual amount of acid by heating the at least partially leached polycrystalline diamond body.

18. The method of claim 17, further comprising rinsing the at least partially leached polycrystalline diamond body before and/or after heating the at least partially leached polycrystalline diamond body.

19. The method of claim 17, wherein heating the at least partially leached polycrystalline diamond body includes heating the at least partially leached polycrystalline diamond body to a temperature about 100° C. to about 700° C.

20. The method of claim 17, wherein heating the at least partially leached polycrystalline diamond body includes heating the at least partially leached polycrystalline diamond body to a temperature about 250° C. to about 400° C.

* * * * *